United States Patent [19]

Bliemeister

[11] 4,171,950

[45] Oct. 23, 1979

[54] APPARATUS FOR RE-AIMING A COAL BURNER PIPE IN A ROTARY KILN

[75] Inventor: Robert M. Bliemeister, Milwaukee, Wis.

[73] Assignee: Allis-Chalmers Corporation, Milwaukee, Wis.

[21] Appl. No.: 937,279

[22] Filed: Aug. 28, 1978

Related U.S. Application Data

[63] Continuation of Ser. No. 795,639, May 10, 1977, abandoned.

[51] Int. Cl.[2] ..... F27B 7/36

[52] U.S. Cl. ..... 432/105; 110/106; 110/182.5; 285/184

[58] Field of Search ..... 432/103, 105, 115; 110/106, 182.5; 431/186, 189; 285/181, 184, 367, 411

[56] References Cited

U.S. PATENT DOCUMENTS

| | | | |
|---|---|---|---|
| 248,462 | 10/1881 | Hartman | 110/182.5 |
| 628,940 | 7/1899 | Hurry et al. | 432/15 |
| 830,513 | 9/1906 | Mannaberg | 110/182.5 |
| 850,731 | 4/1907 | Christensen et al. | 285/184 |
| 1,347,660 | 7/1920 | Reiband | 285/184 |
| 2,124,474 | 7/1938 | Scholtes | 285/184 |
| 2,301,017 | 11/1942 | Cherry | 432/115 |
| 2,480,394 | 8/1949 | Cavers et al. | 431/189 |
| 3,662,696 | 5/1972 | Mahr et al. | 110/182.5 |
| 3,737,179 | 6/1973 | White, Jr. | 285/184 |
| 3,907,340 | 9/1975 | George | 431/189 |

*Primary Examiner*—Henry C. Yuen

*Attorney, Agent, or Firm*—Robert C. Jones

[57] ABSTRACT

Apparatus is disclosed in which a coal burner pipe may be re-aimed into a rotary kiln. The burner pipe extends through a suitable opening provided in the associated hood of the kiln, with the discharge end of the burner pipe being so disposed as to discharge parallel to or obtusely to the axis of the kiln. Exteriorly of the kiln the coal burner pipe is provided with rigid angular pipe sections which can be reoriented relative to each other for effecting the re-aiming of the coal burner pipe within the kiln.

6 Claims, 6 Drawing Figures

APPARATUS FOR RE-AIMING A COAL BURNER PIPE IN A ROTARY KILN

This is a continuation of application Ser. No. 795,639, filed May 10, 1977, now abandoned.

BACKGROUND OF THE INVENTION

This invention relates to fuel feeding means for a rotary kiln, and in particular to the re-aiming of a coal burner pipe within the interior of a rotary kiln for controlling flame impingement and for optimizing heat transfer to the material bed and to control clinker ring build-up within the kiln.

From the prior art it is known to feed pulverized coal via a coal burner pipe which is in communication with the interior of a kiln. This knowledge is exemplified by U.S. Pat. Nos. 1,944,452; 1,945,652 and 2,015,866. However, the prior art, as far as it is known, does not concern itself or teach the advantages obtainable with a coal burner pipe that can be re-aimed during operation of the kiln to obtain optimum heat transfer and flame impingement as well as fuel benefits.

In the construction of a plant, positioning of the coal burner pipe prior to the actual operation of the rotary kiln is accomplished by a more-or-less feel for the location for optimum aiming. Since the coal burner pipe is extremely large and heavy and is usually connected to nonyieldable components such as fans and feeders, re-aiming the coal burner pipe is a difficult and time consuming process. It entails shutting down the kiln, dismantling the coal burner pipe and fan and feed equipment; re-aiming the pipe and modifying and reassembling the components, and finally restarting the kiln. It is, of course, appreciated that once proper treatment of the material bed is obtained, the temperature within the kiln is at a very high operating temperature. Thus, to shut the kiln down for the purpose of re-aiming the coal burning pipe is a costly process. For proper heat transfer, the coal burner pipe needs to be aimable after the kiln has gone into operation and judgments can be made for more accurately adjusting the position of the pipe.

SUMMARY OF THE INVENTION

According to a preferred embodiment of the present invention, a forward section of a steel coal burner pipe extends through a hood of a rotary kiln. The external end of the forward pipe is provided with an adjustable joint which is inexpensive, withstands abrasion and permits re-aiming of the burner pipe. An intermediate pipe section is connected to the adjustable joint and is also connected, via another adjustable joint, to a stationary pipe section of the coal burner pipe. In changing the relationship of the adjustable joints, re-aiming of the forward pipe section within the kiln can be accomplished.

DESCRIPTION OF THE INVENTION

Figure 1:
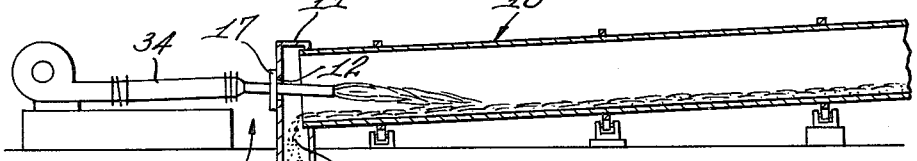
FIG. 1 is a fragmentary view in elevation of a rotary kiln showing the coal burner pipe relationship.

As shown in FIG. 1, a refractory lined rotary kiln 10 is supported for rotation about its own axis which is disposed at an angle relative to ground surface. A hood 11 having a coal burner pipe inlet 12 encloses the lower end of the kiln. Introduction of the raw material is effected through the upper end of the kiln (not shown) with the finished clinker being discharged from the kiln 10 through a discharge opening 16 provided in the hood 11. In the hood 11, the coal burner pipe inlet 12 is located above the central axis of the kiln. An adjustable seal 17 surrounds a forward pipe section 19 of a coal burner pipe 20 to seal the opening 12 through which the forward pipe section extends. The inner end of the forward pipe section 19 is provided with a telescoping extensible extension 21, FIGS. 2 and 3, which when in retracted position is out of the hot zone of the kiln so as to protect it when not in use.

It will be appreciated that during operation the forward pipe extension 21 will always be required to extend into the kiln through the inlet 12 regardless of the angular displacement which must be effected in re-aiming the forward pipe section. It will also be noted that the overall length of the coal burner pipe between the forward pipe section and the stationary or fixed pipe section 43 cannot be significantly altered.

Figure 2:
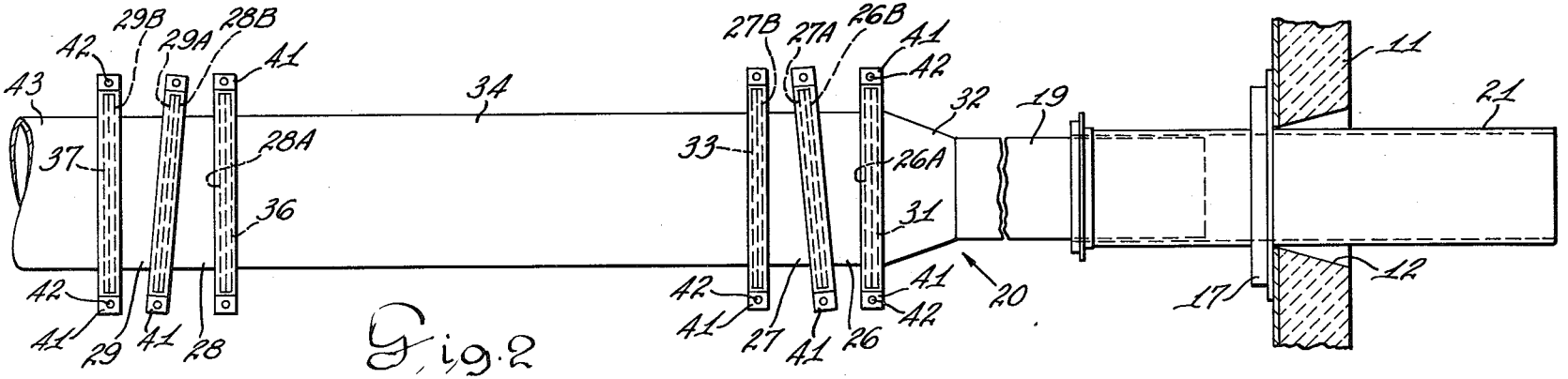
FIG. 2 is an enlarged fragmentary view of the coal burner pipe as originally installed.
Figure 3:
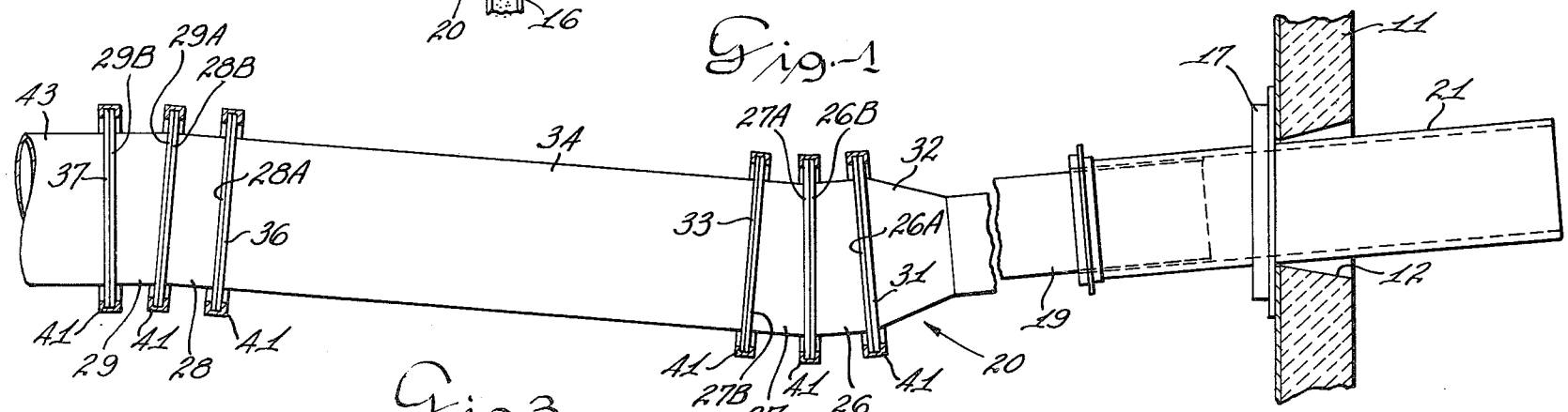
FIG. 3 is an enlarged fragmentary view of the coal burner pipe as re-aimed by operation of the associated adjustable joint.

To effect a re-aiming of the forward pipe section 19 of the coal burner pipe 20 while the rotary kiln is operating, the external portions of pipe 20 includes adjustable angular sections 26, 27, 28 and 29. As shown in FIGS. 2 and 3, the sections 26, 27, 28 and 29 are relatively short sections of pipe cut across the diameter and at an angle to the axis or flowline of the pipe section. The ends of the section are provided with flanges 26A–26B, 27A–28B, 28A–28B and 29A–29B. Section 26 is connected to the flanged end 31 of a flared end portion 32 of the forward pipe section 19 which extends through the hood opening 12. On the other hand, section 27 is connected between section 26 and the flanged end 33 of an intermediate pipe section 34 of the coal burner pipe 20. Connected to the opposite flanged end 36 of pipe section 34 is the angular section 28 which, in turn, receives the angular section 29. As shown, the flange 29B of section 29 is connected to a flanged end 37 of the stationary pipe section 22. Tight connections between adjacent flanges are accomplished by means of commercially available clamping seals 41. The seals are of two-part construction secured in position by means of screws 42, as indicated in FIG. 2.

In operation to re-aim the forward pipe section 19 while the rotary kiln 10 is in operation, the clamps 41 are loosened and the angular sections 26–27 and angular sections 28–29 reorientated with respect to each other to obtain the desired positioning of the pipe section 19. When re-aiming has been satisfactorily accomplished, the clamps 41 are reclamped to reestablish the rigidity of the coal burner pipe.

With the present invention, expensive bellows, flexible tubes and hoses which are difficult to secure in the large-diameter sizes required for coal burner pipes are eliminated; but the adjustability of such material is retained plus the added advantage of abrasive resistance and rigidity that metal pipe provides.

With the spaced apart double pairs of short section of pipe, re-aiming of the inner end is accomplished without abrupt directional flow change. The intermediate long section of pipe 34 also serves to smooth the turbulence introduced by the direction change of the flow path as effected by the angular short sections of pipe 28 and 29 and thereby lessens the abrasive effect of the coal moving through the coal burner pipe at relatively high velocity.

Figure 4:
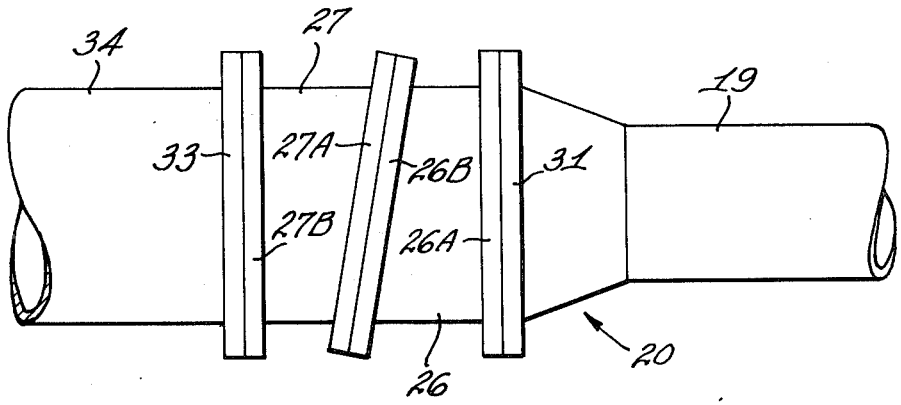
FIG. 4 is an enlarged view of the adjustable joints utilized in FIGS. 2 and 3.
Figure 5:
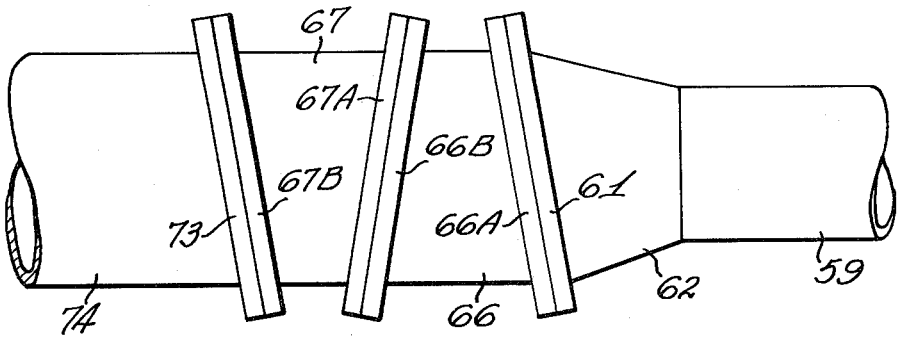
FIG. 5 is a modification of an adjustable joint.

A modification of an adjustable joint arrangement is shown in FIG. 5. As shown, the internal flare end 62 of the forward pipe section 59 is formed at an angle which is the same as the angle end surface of the short pipe section 26. The angled end of the pipe end 59 is provided with a flange 61. The relatively short pipe sections 66 and 67 are formed as trapezoids having axial ends formed at angles which are the same as the angled axial ends of the short pipe sections 26. Both of the short pipe sections 66 and 67 have flanged ends 66A and 66B, 67A and 67B, respectively, which mate with adjacent flanged axial ends to provide a seal connecting means. The associated relatively long pipe section 74 is formed with an angular flanged end 73 which is formed at an angle which is complementary to the angle of the adjacent axial end of the section 67. With the modified adjustable joint as depicted in FIG. 5, a more abrupt adjustment in the re-aiming of the forward pipe section 59 can be accomplished. It will be appreciated that the adjustable joint at the end of the long pipe section 74 opposite the flanged end 73 will be of similar construction. However, it may be desirable in a particular installation where it would be an advantage to utilize one adjustable joint of FIG. 4 and the other adjustable joint constructed as disclosed in FIG. 5.

Figure 6:
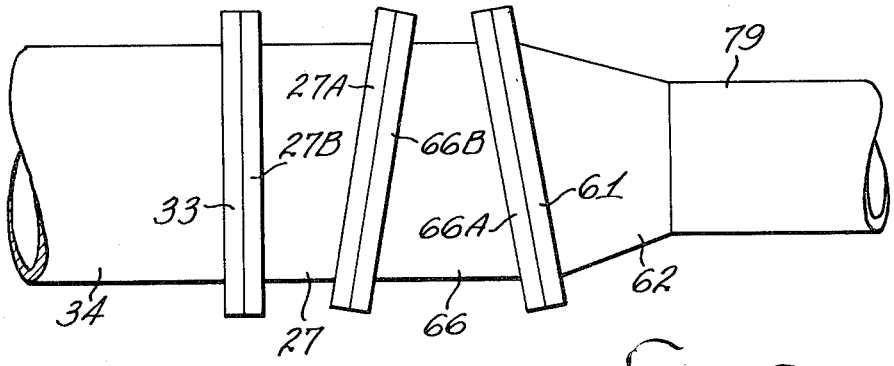
FIG. 6, is a further modification of an adjustable joint utilizing sections from each of the previous joints.

In FIG. 6, another modification of an adjustable joint arrangement is disclosed. The arrangement therein is a composite joint utilizing a short pipe section such as section 27 from FIG. 4 and a short pipe section such as section 66 from the arrangement in FIG. 5. This arrangement is a compromise on the angular adjustment that can be made in re-aiming the forward pipe section 79.

The embodiments of the invention in which an exclusive property or privilege is claimed are defined as follows:

1. In a rotary kiln having an inlet for passage for a coal burner pipe for directing pulverized coal under pressure into the interior of the kiln;

a forward metallic coal burner pipe section for pulverized coal extending into the kiln through the inlet and having a flow axis;

a radial outwardly extending flange secured to the outer end of said forward pipe section, said flange having its outer axial face surface in the plane in which the axial end of said pipe is located so that the ends of said pipe and flanges presents a flush surface;

first and second relatively short pipe sections each having a flow axis, said short pipe sections each having at least one axial end formed on a bias with respect to their flow axis;

radial extending flanges secured to each end of said first and second short pipe sections, said flanges having their outer axial faces in the same plane as are the associated ends of said first and second pipe sections, said short pipe sections being releasably connected together with their bias axial ends in adjacent flange face mating relationship to establish an angular space-less joint which may be adjusted as desired;

a third pipe section having a flow axis and having its ends provided with radial flanges the axial faces of which are disposed in the same plane in which the associated ends of said third pipe are in, said third pipe section having one flanged end releasably connected to the flanged free end of said second short pipe section in flow relationship and in flange face mating relationship to establish an angular space-free joint which may be adjusted as desired, the free end of said first short pipe section being connected in flow relationship to the external end of said forward pipe section with the adjacent flanged ends being in flange face mating relationship to establish an adjustable space-less joint; and, releasable clamp means associated with the abutting flanged ends of said pipe sections to releasably clamp said pipe sections in space-less tight adjusted engagement;

whereby the relationship established between said first and second short pipe sections effects the angle at which said forward pipe section extends into the kiln though the inlet.

2. A rotary kiln according to claim 1 wherein the biased axial ends of said first and second short pipe sections are formed at the same angle with respect to their flow axis.

3. A rotary kiln according to claim 1 wherein said first and second relatively short pipe sections are each formed with two axial ends which are formed on a bias with respect to their flow axis.

4. A rotary kiln according to claim 3 wherein the axial ends of each of said first and second short pipe sections are formed at the same angle with respect to their flow axis;

said external axial end of said forward pipe section being formed on a bias with respect to its flow axis, the angle of the external end being complementary to the angle of the adjacent axial end of the first short pipe section; and said axial end which connects with the free end of said second short pipe being complementary to the axial end of said second short pipe to which it connects.

5. A rotary kiln according to claim 3 wherein the biased axial ends of each of said first and second short pipe sections are included in angular planes which intersect.

6. In a rotary kiln having an inlet for a coal burner pipe for directing pulverized coal under pressure into the kiln;

a metallic coal burner pipe for pulverized coal including;

a forward pipe section having a flow axis and extending into the kiln through the inlet opening, said forward section being angularly adjustable for re-aiming the flow axis;

a stationary pipe section having a flow axis;

an intermediate pipe section having a flow axis, disposed between said forward pipe section and said stationary pipe section;

first adjustable pipe means connected between the external end of said forward pipe section and an end of said intermediate pipe section and operble to maintain a flow relationship between said forward and intermediate pipe sections;

second adjustable pipe means connected between said stationary pipe section and the opposite end of said intermediate pipe section and operable to maintain a flow relationship between said stationary pipe section and said intermediate pipe section; and, releasable clamping means associated with the adjacent abutting ends of said pipe sections to clamp said pipe sections in tight space-less adjusted relationship;

whereby an adjustment of said first adjustable pipe means effects the angle at which said forward pipe section extends through the inlet opening and also effects the angular relationship between said forward pipe section and said intermediate pipe section and said second adjustable pipe means can be adjusted to compensate for the change in the angular relationship of said forward pipe section and said intermediate pipe section while maintaining tight space-less joint relationship.

* * * * *